US006623357B2

(12) United States Patent
Chowdhury

(10) Patent No.: US 6,623,357 B2
(45) Date of Patent: Sep. 23, 2003

(54) PAPER TOKEN AND COMPLEMENTARY COUPON DISPENSER

(75) Inventor: Anisur Rahman Chowdhury, Reno, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 09/892,104

(22) Filed: Jun. 26, 2001

(65) Prior Publication Data

US 2002/0198043 A1 Dec. 26, 2002

(51) Int. Cl.[7] ..... A63F 9/34

(52) U.S. Cl. ..... 463/25; 221/95; 221/197; 700/231

(58) Field of Search ..... 463/25, 26, 27, 463/28, 16, 20; 902/23; 194/206, 207, 350; 221/197, 277, 255, 231, 93–95; 700/231, 232; 235/379, 380, 381

(56) References Cited

U.S. PATENT DOCUMENTS

| | | | | |
|---|---|---|---|---|
| 4,607,155 A | * | 8/1986 | Nao et al. | |
| 5,290,033 A | | 3/1994 | Bittner et al. | 273/138 A |
| 5,397,125 A | * | 3/1995 | Adams | |
| 5,564,546 A | * | 10/1996 | Molbak et al. | |
| 5,609,337 A | | 3/1997 | Clapper, Jr. | 273/138.2 |
| 5,635,696 A | * | 6/1997 | Dabrowski et al. | |
| 5,674,128 A | * | 10/1997 | Holch et al. | |
| 5,761,647 A | | 6/1998 | Boushy | |
| 5,779,549 A | | 7/1998 | Walker et al. | |
| 5,823,874 A | * | 10/1998 | Adams | |
| 5,919,091 A | * | 7/1999 | Bell et al. | |
| 5,935,000 A | | 8/1999 | Sanchez, III et al. | 463/17 |
| 5,941,771 A | | 8/1999 | Haste, III | 463/17 |
| 5,943,241 A | | 8/1999 | Nichols et al. | 364/479.02 |
| 5,949,042 A | | 9/1999 | Dietz, II et al. | 235/375 |
| 5,980,385 A | | 11/1999 | Clapper, Jr. | 463/17 |
| 5,993,316 A | * | 11/1999 | Coyle et al | |
| 6,048,269 A | * | 4/2000 | Burns et al. | |
| 6,098,837 A | | 8/2000 | Izawa et al. | 221/154 |
| 6,110,042 A | * | 8/2000 | Walker et al. | |

(List continued on next page.)

FOREIGN PATENT DOCUMENTS

| | | | |
|---|---|---|---|
| GB | 2144567 | * | 3/1985 |
| GB | 2 251 112 A1 | | 6/1992 |
| WO | 9906969 | * | 2/1999 |

OTHER PUBLICATIONS http://www.jcm–american.com web pages (2) relating to HBP–10 Bill dispenser and HBP–5 Note Hopper.

International Search Report dated Oct. 9, 2002 for International Application No PCT/US02/19845, International Filing Date Jun. 24, 2002.

*Primary Examiner*—Michael O'Neill
(74) *Attorney, Agent, or Firm*—Marshall, Gerstein & Borun

(57) ABSTRACT

An electronic gambling unit for allowing a user to play a gambling game, and for dispensing at least one of a plurality of types of value to the user based on user preference information at the conclusion of the gambling game, may generally include a display unit capable of generating color images or other display mechanisms capable of displaying images associated with the gambling game. The electronic gambling unit may further include an input device that allows the user to input information, a value-accepting mechanism capable of allowing the user to deposit a medium of currency, and a value-dispensing mechanism containing a first item representing a first type of value and a second item representing a second type of value, and being capable of dispensing the items to the user. Moreover, the electronic gambling unit may include a controller operatively coupled to the display unit, the input device, the value-accepting mechanism, and the value-dispensing mechanism. The controller may include a processor and a memory operatively coupled to the processor.

35 Claims, 11 Drawing Sheets

U.S. PATENT DOCUMENTS 6,168,522 B1 * 1/2001 Walker et al.
6,193,608 B1 2/2001 Walker et al.
6,264,556 B1 * 7/2001 Izawa et al.
6,280,326 B1 * 8/2001 Saunders
6,280,328 B1 * 9/2001 Holch et al.
6,289,261 B1 * 9/2001 Hiedel et al.
6,293,867 B1 * 9/2001 Heidel et al.
6,315,665 B1 * 11/2001 Faith
6,332,099 B1 * 12/2001 Heidel et al.
6,352,175 B2 * 3/2002 Izawa et al.

* cited by examiner

PAPER TOKEN AND COMPLEMENTARY COUPON DISPENSER

TECHNICAL FIELD

This invention relates to casino game playing services for gambling units such as slot machines and video poker machines and, more particularly, to methods of redeeming accumulated credits by dispensing multiple types of awards from a single gambling unit.

BACKGROUND ART

Gaming machines generally dispense a single type of prize in exchange for game credits accumulated by the user during game play. The prizes are typically a single denomination of currency (e.g., nickels, quarters, half dollars, dollar coins, and single denomination of paper currency), a single denomination of coin tokens, or a single denomination of paper tokens such as token bills, lottery tickets, complementary coupons and the like.

One example of a paper dispenser is the HBP-5 unit manufactured and sold by Japanese Coin Mechanisms (JCM) American Corporation of Las Vegas, Nev., for gaming machines to dispense paper tokens, such as token bills or lottery tickets. The unit contains a single paper token cassette, a paper token transport mechanism, electronics to monitor the paper token movement, and the electronics and communication interface to allow the gaming machine to control the unit. The current design of the cassette allows for the unit to dispense only one denomination or type of paper token, e.g., $10 token bills or lottery tickets. The single paper token cassette limits the versatility of the unit where a casino desires to offer a variety of award types to the users.

In addition, dual compartment dispensers capable of dispensing multiple denominations of paper currency or token bills have been developed and demonstrated at trade shows. In particular, one such dual compartment dispenser has been developed and demonstrated by Glory Money Systems of West Caldwell, N.J.

SUMMARY OF THE INVENTION

According to one aspect, the present invention may be embodied in an electronic gambling unit for allowing a user to play a video gambling game, and for dispensing at least one of a plurality of types of value to the user at the conclusion of the video gambling game. Such an electronic gambling unit may include a display unit capable of generating color images or other display mechanisms capable of displaying images associated with the video gambling game. The electronic gambling unit may further include an input device that allows the user to input information, a value-accepting mechanism capable of allowing the user to deposit a medium of currency, and a value-dispensing mechanism containing a first item representing a first type of value and a second item representing a second type of value, and being capable of dispensing the items to the user. Moreover, the electronic gambling unit may include a controller operatively coupled to the display unit, the input device, the value-accepting mechanism, and the value-dispensing mechanism. The controller may include a processor and a memory operatively coupled to the processor.

The controller may be programmed to allow the user to make a wager via the input device, and to cause a video image representing the video gambling game to be generated on the display unit after the user makes a wager. The controller may be further programmed to determine the outcome of the video gambling game and a payout associated with the outcome. The controller may be further programmed to cause the value-dispensing mechanism to dispense at least one of the first and the second items to the user after the payout is determined based on information input by the user at the input device.

The controller may be programmed to cause the display unit to generate a value selection graphic instructing the user to select at least one of the first and the second types of value via the input device, which may be a plurality of buttons or part of a touch-sensitive video display screen. Alternatively, the input device may be an electronic reader capable of reading an object having user identification information or user preference information stored thereon, with the items or combination of items dispensed to the user being determined based on the user preference information stored on the object or retrieved via a player tracking interface from a player tracking system. Additionally, the first and the second items may be combinations of token bills having particular monetary values and complementary coupons for game tokens, gifts, meals, rides, shows, goods and services.

The controller may be further programmed to increment user information indicative of the frequency and volume with which the user plays the electronic gambling unit, and to determine whether the user information exceeds a threshold value. If the user information exceeds the threshold value, the controller may be further programmed to cause the value-dispensing mechanism to dispense one of the first and second items to the user.

According to another aspect, the present invention may be embodied in a method of dispensing at least one of a plurality of items, each representing a type of value to a user at the conclusion of a video gambling game of an electronic gambling unit. Such a method may include executing the video gambling game, determining an outcome of the video gambling game and a payout associated with the outcome of the video gambling game after the execution of the video gambling game, and dispensing at least one of the items to the user via a value-dispensing mechanism based on information input by the user at an input device. The method may further include generating a value selection graphic at a display unit of the electronic gambling unit, allowing the user to select at least one of a plurality of types of value via the input device, which may be a plurality of buttons or a part of a touch-sensitive video display screen, and dispensing at least one item based on the selections made by the user. Still further, the method may include obtaining user information from an object read by an electronic reader and causing the value-dispensing mechanism to dispense at least one item based on the user information stored on the object or obtained from a player tracking system via a player tracking interface. The items dispensed by the value-dispensing mechanism may be a combination of token bills having particular monetary values and complementary coupons for one of game tokens, gifts, meals, rides, shows, goods and services.

These and other features of the present invention will be apparent to those of ordinary skill in the art in view of the description of the preferred embodiments, which is made with reference to the drawings, a brief description of which is provided below.

DESCRIPTION OF THE EMBODIMENTS

Figure 1:
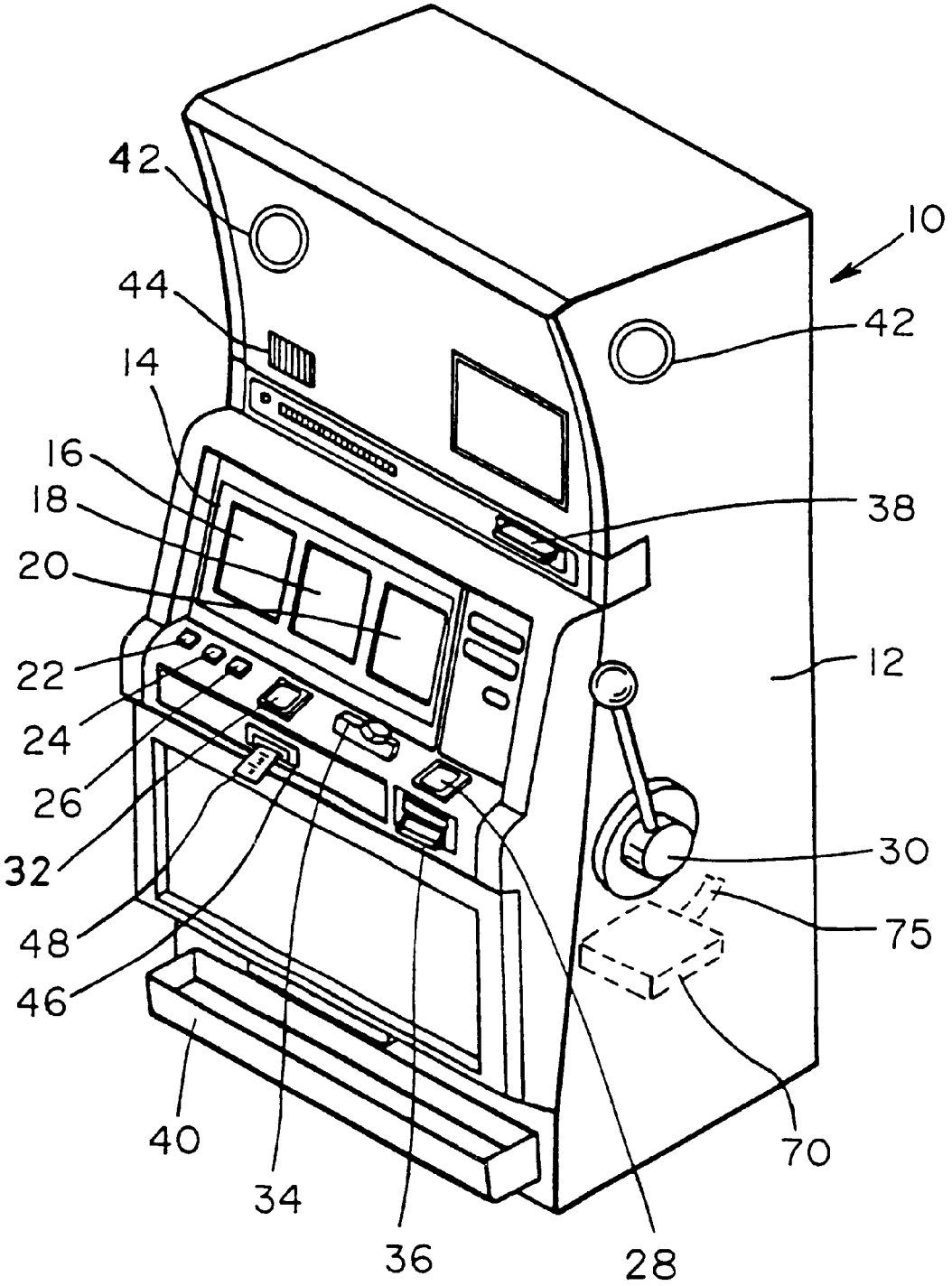
FIG. 1 is an exemplary illustration, partially in section, of a side view of an electronic gambling unit designed in accordance with the teachings of the present invention.

Turning now to the figures, as shown in FIG. 1, a casino gambling unit 10, such as a slot machine or any other like apparatus, may generally include a cabinet 12 which generally surrounds the machine interior (not shown) and is viewable by users. It should be noted at this point that the gambling unit 10 described herein is merely exemplary. Numerous other types of gambling units having various different structures and methods of operation may be utilized to implement the method and apparatus of the present invention.

The gambling unit 10 may further include a display unit 14 disposed on the front of the cabinet 12 for displaying graphics and information associated with the video gambling game or games that the user may play at the gambling unit 10. For example, the display unit 14 may display graphics for, inter alia, a plurality of reels 16–20 on a gambling unit 10 configured for the user to play video slots. The display unit 14 may be a color display unit, a monochrome display or any other suitable display. Further, the display unit 14 may be embodied in a cathode ray tube (CRT) monitor, a plasma display, a liquid crystal display (LCD) or any other suitable display technology. For example, the display unit 14 may be embodied in a Multisync LCD Model 1810 available from NEC Technologies. The gambling unit 10 may also include a number of buttons 22–28 that a user may actuate to make bets or wagers, and game-specific selections such as holding or discarding cards, and a handle or arm 30, a spin button 32, or any other type of input device.

The configuration of the gambling unit 10 of FIG. 1 is exemplary, and in no way limiting as to the types of gambling units contemplated for use with the method and apparatus of the present invention. For example, the display unit 14 may display graphics of dealt cards or configurations of numbers for other video gambling games such as video poker, video blackjack, video keno and the like. Still further, the gambling unit 10 may be a traditional slot machine having mechanical reels instead of the display unit 14 and still have application with the method and apparatus of the present invention. Additionally, one or more of the arm 30 and buttons 22–28 and 32 on the gambling unit 10 may be replaced by other types of input devices that are known in the art. For example, the display unit 14 described above may have a touch-sensitive device installed thereon. Such a touch screen may be available from MicroTouch or any other suitable vendor. Other combinations and configurations of mechanical and electronic displays, and input and activation devices will be apparent to those skilled in that art and are contemplated for use with the present invention.

Figure 3:
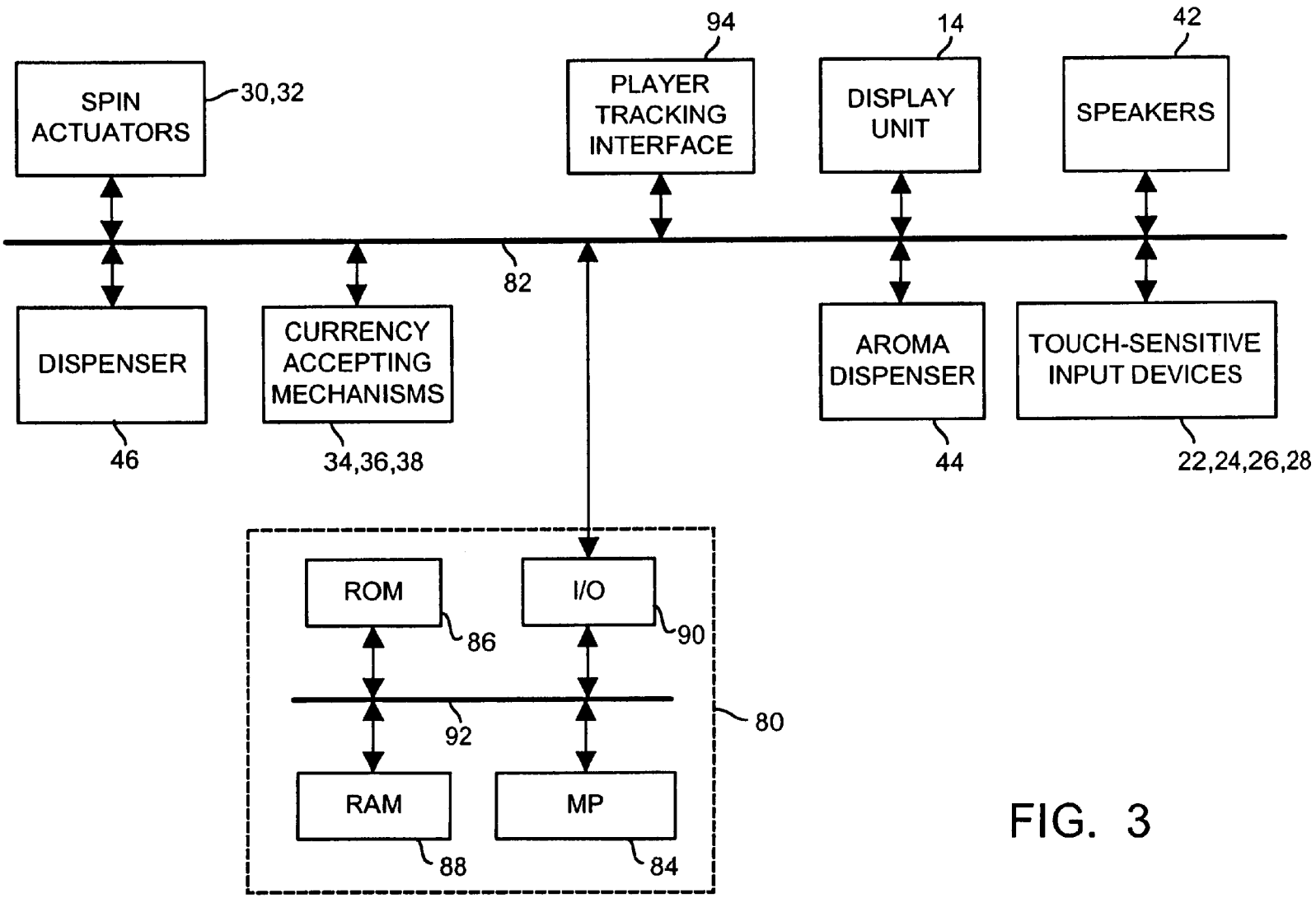
FIG. 3 is an exemplary block diagram of the hardware components of the electronic gambling unit of FIG. 1.

Currency accepting mechanism 34–38 may be disposed on the front of the gambling unit 10 or in any other suitable location. The currency accepting mechanisms 34–38 may be embodied in any device that can accept value from the user. As used herein the term "value" is intended to encompass conventional tokens, coin or bill currency or any other suitable objects that may be representative of some monetary value. Furthermore, as used herein the term value may include cards having value associated therewith (e.g., printed cards, smart cards or the like). For example, slot 34 may accept coins or tokens, bill acceptor 36 may accept and validate bill currency and vouchers, and card reader 38 may accept printed cards, smart cards or any other suitable electronic currency that is accepted by the casino. By way of a particular example, the bill validator 36 may be a validator that is commercially available from Japanese Coin Mechanisms (JCM) under model number WBA-12-SS. As shown in FIG. 3, the currency accepting mechanism may be coupled to, and controlled by, a controller 80. When a user deposits value into the currency accepting mechanisms 34–38, a representation of the value that the user has may be displayed to the user on the display unit 14 or on some other display disposed on the cabinet 12. Additionally, a currency accepting mechanism such as the card reader 38, upon receiving a smart card or player tracking card, may interface with a player tracking system to which the gambling unit 10 is connected to acquire user profile, preference and credit information for the user for use by the gambling unit 10 in a manner described more fully below. As the user plays various video gambling games, the value may be incremented as the user wins and may be decremented as the user loses.

The gambling unit 10 may include additional features to enhance the user's game playing experience, such as audio speakers 42 and an aroma dispenser 44.

The audio speakers 42, which may be embodied in speakers that are commercially available from Boston Acoustics under model number $CX9^3$, or may be embodied in any other suitable speakers, cooperate with a sound generator (not shown) to provide various forms of audio that are relevant to the video gambling game that the user is playing. For example, the sound generator, which may be any suitable and known audio generating circuit, may generate signals representing sounds such as the noise of spinning slot machine reels, a dealers voice, music, announcements or any other suitable audio related to a video gambling game. The aroma dispenser 44, which may be mounted above the display unit 14 or may be mounted in any other suitable location on the gambling unit 10, may be manufactured by MicroScent or DigiScents.

A multi-compartment dispenser 46 may also be disposed on the front of the gambling unit 10 or in any other suitable location. The dispenser 46, which may be responsive to a controller, may be used for dispensing multiple types of ticket vouchers 48 or currency reflecting the winnings accumulated by a user. For example, when a user desires to cash out, the dispenser 46 may dispense one or more ticket voucher 48 having a combined value equal to the number of user credits being redeemed by the user. The user may then redeem the dispensed ticket voucher(s) 48 for cash, a check, credit at a casino facility, or for any other type of value as indicated on the ticket voucher(s) 48, such as free gaming tokens, gifts, meals, shows, rides, or any other complimentary item of a certain monetary value. Alternatively, if the electronic gambling unit 10 is used for lottery purposes, the dispensed ticket voucher(s) 48 may be redeemed at a lottery facility. The particular ticket voucher(s) 48 dispensed by the multi-compartment dispenser 46 may be based on the user's performance during game play, award elections made by the user, information about the user provided by a smart card or player tracking system, and the like.

Figure 1A:
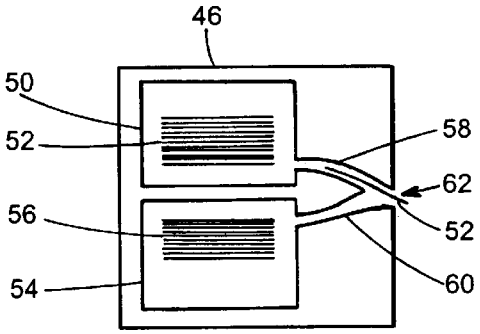
FIG. 1A is a exemplary schematic illustration of dispenser that may be implemented in the gambling unit of FIG. 1.

One example of a dispenser 46 is illustrated schematically in FIG. 1A. The dispenser 46 may include a first compartment or area 50 containing ticket vouchers 52 representing a first type of value, and a second compartment or area 54 containing ticket vouchers 56 representing a second type of value. The ticket vouchers 52 may be dispensed from the first compartment 50 through a channel 58, and the ticket vouchers 56 may be dispensed from the second compartment 54 through a channel 60. The channels 58, 60 intersect so that the ticket vouchers 52, 56 from either compartment 50, 54 are dispensed from the dispenser 46 and, consequently, from the gambling unit 10 through a single slot 62. For example, as illustrated in FIG. 1A, the ticket voucher 52, such as paper currency or an award ticket is passing from the compartment 50, through the channel 58 and out of the slot 62. Mechanisms for causing the ticket vouchers stored in a given compartment to be dispensed from the compartment are well known to those skilled in the art and are contemplated as having use with the present invention.

Figure 2:
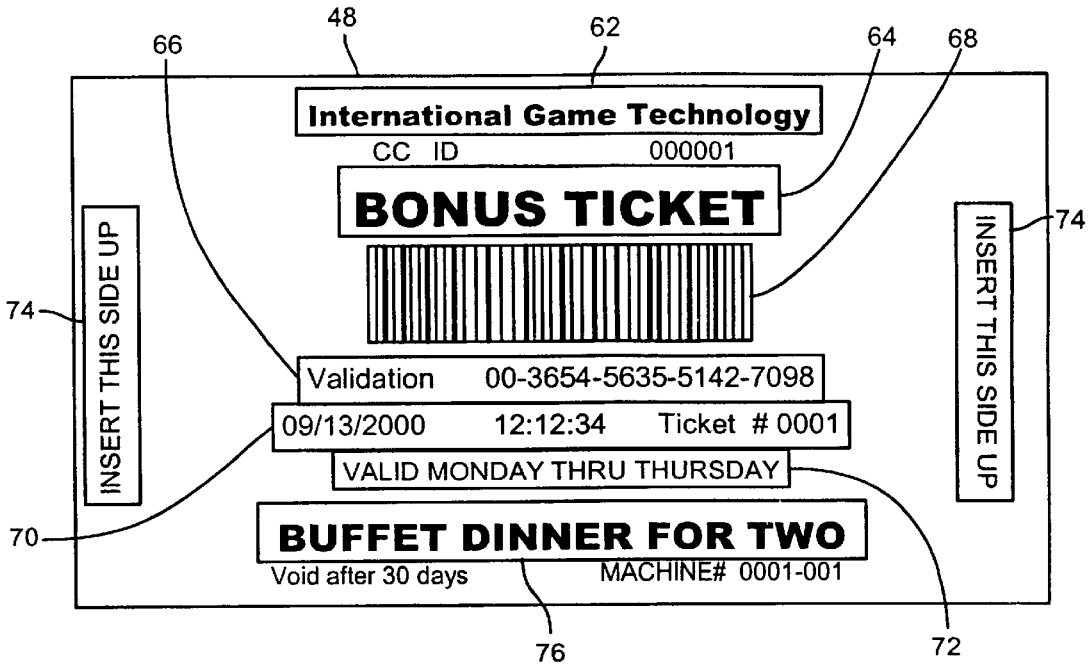
FIG. 2 is an exemplary illustration of an award ticket that may be dispensed by the gambling unit of FIG. 1.

An illustration of one possible example of a ticket voucher 48 that may be dispensed by the dispenser 46 is illustrated in FIG. 2. Referring to FIG. 2, the ticket voucher 48 may be composed of paper or another printable material and may have printed information including the casino name 62, the type of ticket 64, a validation number 66 and associated bar code 68 with control and security information, the date and time of preparation 70, redemption instructions 72 and restrictions 74, a description of an award 76, and any other information that may be necessary or desirable. Different types of ticket vouchers could be used, such as bonus ticket vouchers, cash-redemption ticket vouchers, casino chip ticket vouchers, extra game play ticket vouchers, merchandise ticket vouchers, restaurant ticket vouchers, show ticket vouchers, etc. The ticket vouchers could be printed with an optically readable material such as ink, or data on the ticket vouchers could be magnetically encoded.

During typical use of the gambling unit 10, a user inserts into the gambling unit 10 value that the user may bet. For example, a user may deposit tokens or coins via the slot 34, may insert a card having information representative of value into the card acceptor 38 or may insert a monetary bill into the bill acceptor 36. The following description refers to value being inserted into and dispensed from the gambling unit 10. Once the gambling unit 10 recognizes that the user has deposited value, the user may make a wager using the buttons 22–28, which may allow the user to wager various units of value on the outcome of the game. After making a wager, the user begins a game either by pulling the arm 30 or by actuating the spin button 32, either of which causes the gambling unit to graphically spin the reels 16–20 for a period of time.

As the reels 16–20 spin, the gambling unit 10 determines random reel stop positions and stops the reels 16–20 from spinning according to the determined reel stop positions. As the reels 16–20 are stopped, symbols representative of the game outcome, which are disposed on the periphery of the reels 16–20, are displayed to the user and the gambling unit 10 determines the outcome of the game. If the gambling unit 10 determines that the outcome of the game is a "winner," the gambling unit 10 pays out either by dispensing value to the user or by incrementing the number of credits available to the user to wager on the game. The concept of dispensing value may include dropping tokens into a payout tray 40, adding value to a card placed in the card acceptor 38, dispensing a ticket voucher 48 from the dispenser 46, accumulating value for the user within the gambling unit 10 or any other suitable technique of distributing value to a user. If the outcome of the game is a winner, the game ends after the gambling unit 10 pays out. However, if the outcome of the game is not a winner, the combination of symbols displayed to the user is not a winning combination, the gambling unit 10 does not pay out and the game simply ends with the user losing the wagered value.

FIG. 3 is a block diagram of a number of components that may be incorporated into the gambling unit 10. Referring to FIG. 3, the gambling unit 10 may include a game controller 80 disposed within the cabinet 12 of the electronic gambling unit 10. The game controller 80 may be coupled to the display unit 14, the audio speakers 42, the aroma dispenser 44, the dispenser 46, and other components of the gambling unit 10 via a cabling harness (or bus) 82 running through the interior of the cabinet 12 in the manner depicted schematically in FIG. 3. The game controller 80 may be embodied in hardware that is commercially available in, for example, the International Game Technology "Game King" platform for video gambling machines. The game controller 80 may be embodied in a 16 or 32 bit, 16 megahertz (MHZ) 80C960SA microcontroller, which is commercially available from Intel, or may be embodied in any other suitable microcontroller. As shown in detail in FIG. 3, the game controller 80 may include a microcontroller or microprocessor (MP) 84, a read-only memory (ROM) 86, a random-access memory (RAM) 88 and an input/output (I/O) circuit 90, all of which may be interconnected via an address/data bus 92.

It should be appreciated that although only one microprocessor 84 is shown, the controller 80 could include multiple microprocessors 84. Similarly, the memory of the controller 80 could include multiple RAMs 88 and multiple ROMs 86. Although the I/O circuit 90 is shown as a single block, it should be appreciated that the I/O circuit 90 could include a number of different types of I/O circuits. The RAM(s) 88 and ROM(s) 86 could be implemented as semiconductor memories, magnetically readable memories, optically readable memories, and the like. For example, a memory such as any one, or any suitable combination, of an electrically programmable read only memory (EPROM), an electrically erasable programmable read only memory (EEPROM), a one time programmable read only memory (OTP ROM), a static random access memory (SRAM), FLASH or any other suitable memory element may be externally connected to the microprocessor 84. Furthermore, the memory(ies) may be embodied in other computer-readable media such as optical media, e.g., CDs, rewritable CDs, DVDs and the like, or magnetic media, e.g., floppy disks, hard drives, zip disks and the like.

FIG. 3 also illustrates that the components shown in FIG. 1 could be connected to the I/O circuit 90 via a respective direct line or conductor. Different connection schemes could be used. For example, one or more of the components shown in FIG. 9 could be connected to the I/O circuit 90 via a common bus or other data link that is shared by a number of components. Furthermore, some of the components could be directly connected to the microprocessor 84 without passing through the I/O circuit 90. Further detail regarding the functionality of the game controller 80 is described hereinafter with respect to, FIGS. 4–11.

As previously mentioned, the controller 80 may be coupled to the electrical components of the gambling unit 10 as described in relation to FIG. 1 via bus 82. In addition, the gambling unit 10 may be connected, along with other gambling units, to a player tracking system via a player tracking interface 94. The player tracking interface 94 may facilitate the exchange of player tracking information for the user between the controller 80 and a central repository. For example, when a user inserts a smart card or player tracking card in the card acceptor 38, the controller 80 may issue a request through the player tracking interface 94 for user preference information such as whether the user prefers to be paid in tokens, tracking system credit, token bills, award coupons for cash, credit, free gaming tokens, goods, meals, shows, rides, and the like.

As an example of an application implemented through the player tracking system and player tracking interface 94, the casino may allow the user to accumulate casino points based on the volume and frequency of the user's game play in the casino. When the user accumulates various threshold levels of casino points, the casino points may be redeemed for game credits, complementary goods and services in the casino and accompanying hotel, and the like. The smart card or player tracking card in the card acceptor 38 exchanges information with the player tracking system relating to the user via the player racking interface 94 as the user plays at the gambling unit 10. The user's game play generates the casino points which are stored either on the smart card or in the player tracking system. In previously known systems, the user then takes the smart card or player tracking card to a remote cashier or kiosk to redeem the accumulated casino points.

One manner in which the gambling unit 10 may operate is described below in connection with a number of flowcharts which represent a number of portions or routines of one or more computer programs, which may be stored in one or more of the memories of the controller 80. The computer program(s) or portions thereof may be stored remotely, outside of the gambling unit 10, and may control the operation of the gambling unit 10 from a remote location. Such remote control may be facilitated with the use of a wireless connection, or by an Internet interface (not shown) that connects the gambling unit 10 with a remote computer (not shown) having a memory in which the computer program portions are stored via the Internet. The computer program portions may be written in any high level language such as C, C++ or the like or any low-level, assembly or machine language. By storing the computer program portions therein, various portions of the memories 86, 88 are physically configured, either magnetically (e.g., in the case of a magnetic memory), electrically (e.g., in the case of a semiconductor memory) or structurally (e.g., in the case of an optical memory), in accordance with computer program instructions.

Figure 4:
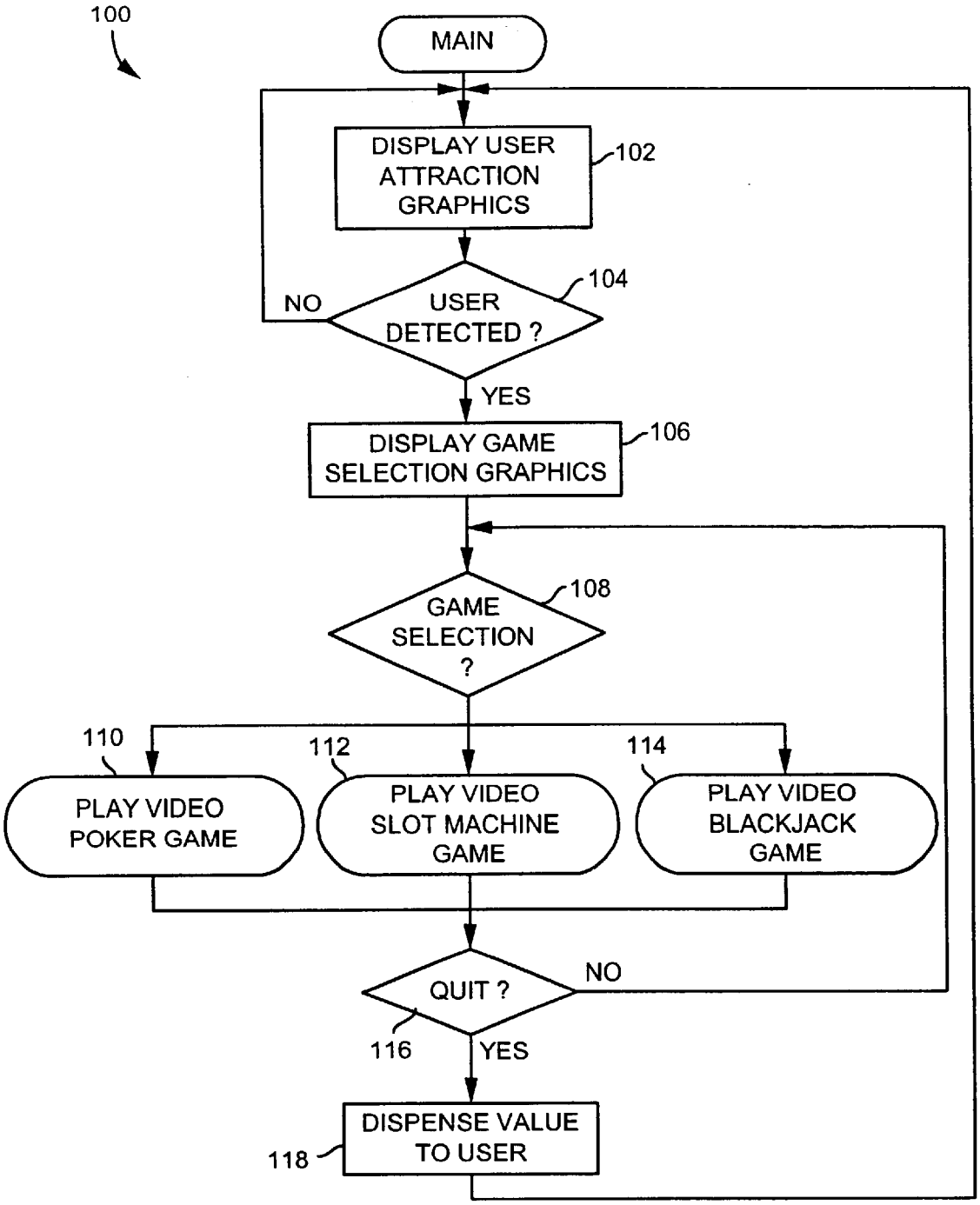
FIG. 4 is an exemplary flow diagram of a main control routine that may be implemented by the controller of FIG. 3.

As shown in FIG. 4, a main routine 100 may begin execution at a block 102 at which user attraction graphics may be displayed on the display unit 14. User attraction graphics may include a scrolling list of games that may be played on the electronic gambling unit 10, cartoons, videos, etc. While graphics are being displayed, a block 104 intermittently checks to see if a user is detected. Such a function may be carried out by, for example, polling the currency accepting mechanisms 34–38 or the touch-sensitive input device. Alternatively, the currency accepting mechanisms 34–38 and touch-sensitive devices may be configured to notify the controller 80 when valid currency is inserted or user contact is detected, respectively. As long as no user is detected, control passes from the block 104 back to the block 102. If, however, the block 104 determines that a user is present, control passes to a block 106.

The execution of the block 106 causes the display of a game selection graphic to the user. The game selection graphic may include a list of video gambling games that may be played on the electronic gambling unit 10. Additionally, at the block 106, the user may be prompted to deposit value into the electronic gambling unit, via the currency accepting mechanisms 34–38 . The execution of the routine 100 may not proceed past the block 106 until the user deposits at least the minimum value required for the gambling unit 10. Any value that the user deposits will be stored as credit.

After the block 106 displays the list of available video gambling games to the user, a block 108 detects which game has been selected and branches control to one of subroutines 110–114, each of which represents a particular video gambling game. It should be noted that although three subroutines are shown in FIG. 4, more, fewer or different subroutines representing more, fewer or different video gambling games may be used. For example, a game such as slots with mechanical wheels will forego the game selection block 108 and proceed directly to playing the mechanical slot machine game. Accordingly, more, fewer or different video gambling games may be present on any given electronic gambling unit 10. The description of the subroutines 110–114 is undertaken with respect to FIGS. 5, 7 and 9 after the remaining blocks of FIG. 4 are described.

After one of the subroutines 110–114 have been executed, control passes to a block 116, which queries whether the user has expressed a desire to stop playing the electronic gambling unit 10. The user may express such a desire by selecting a quit graphic displayed on the display unit 14 or through any other suitable manner that informs the game controller 80 of the user's desire to stop playing the electronic gambling unit 10. If the user does not desire to quit, control passes from the block 116 back to the block 108 so that the user may select another video gambling game to play. If, however, the user desires to quit, control passes from the block 116 to a block 118, which cashes out the user by dispensing coins, tokens or currency, dispensing tickets or coupons from the dispenser 46, adding value to the user's smart card or player tracking profile, or otherwise reward the user for credits and casino points accumulated while playing the gambling unit 10 in a manner discussed more fully hereinafter. After the block 118 has completed execution, control passes back to the block 102, at which time the electronic gambling unit 10 again displays graphics to attract another user.

Figure 5:
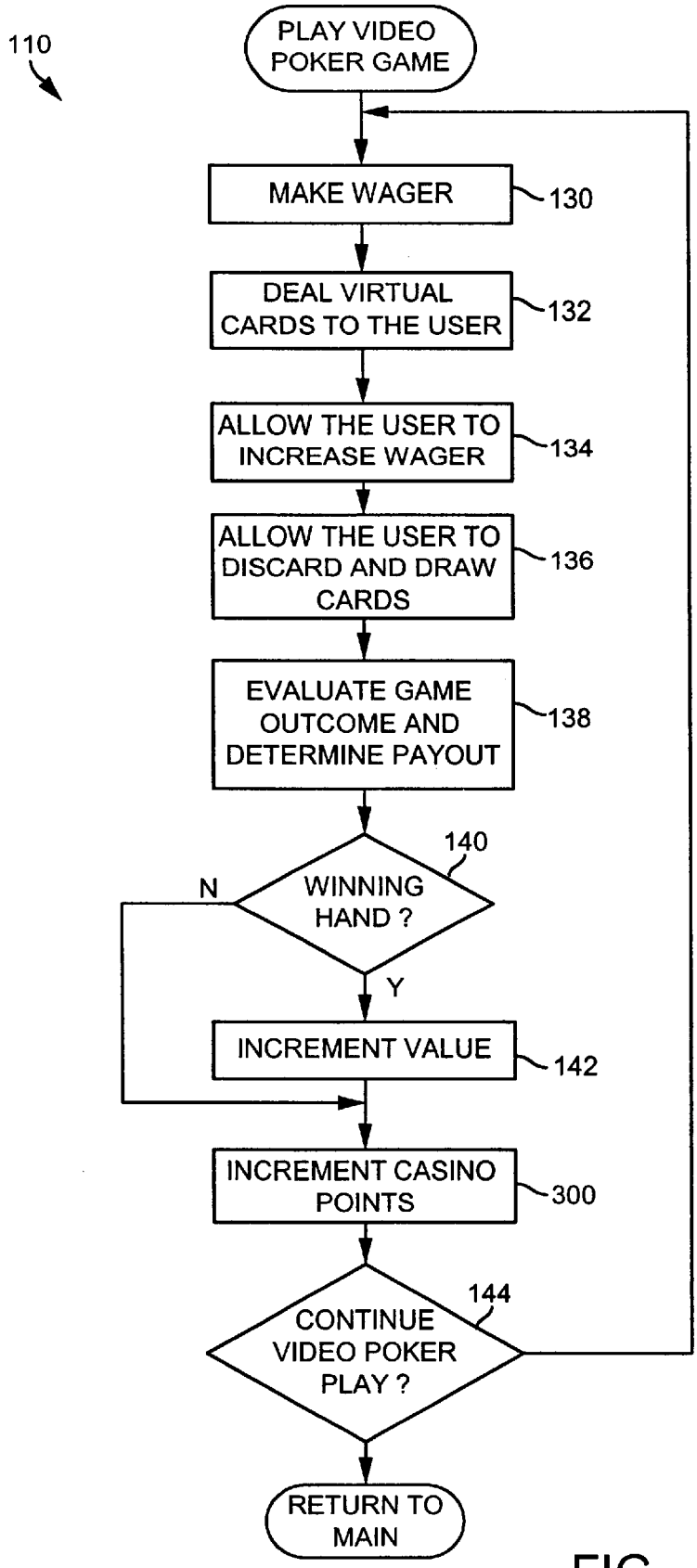
FIG. 5 is an exemplary flow diagram of a play video poker game routine that may be implemented by the controller of FIG. 3.

When the block 108 determines that the user desires to play a video poker game, control passes to the subroutine 110, which is illustrated in detail in FIG. 5. As described hereinafter, the various blocks of the subroutine 110 recite various functions that are carried out by the game controller 80 in conjunction with the display unit 14 to make certain graphics appear on the display unit 14. Exemplary graphics for a video poker game are shown and described in conjunction with FIG. 6.

At a block 130, the subroutine 110 requests the user to make a wager and, after a wager is entered, control passes to a block 132, at which a virtual hand of cards are dealt to the user. After the virtual hand has been dealt to the user, the user may have an opportunity at the block 134 to increase the initial wager made at the block 130. After the block 134 executes, control passes to a block 136, which allows the user to discard and draw cards in an attempt to improve the user's virtual hand.

After the user has had the opportunity to improve his or her hand at the block 136, control passes to a block 138, at which the game controller 80 determines the outcome of the game and determines the payout. If the user has won the game (e.g., the user's hand matches one of a predetermined list of winning hands), a block 140 passes control to a block 142 which increments the user's value based on the results determined at the block 138. If, however, the user has not won the game, the user forfeits the wagers made at the blocks 130 and 134, and block 140 bypasses the block 142.

After the user's value has been incremented at the block 142 or control is passed directly from block 140 after a losing hand, a block 300 increments casino points for users for which casino points are being accumulated and redeemed in a manner more fully described hereinafter. After the user's casino points have been incremented at the block 300, a block 144 queries whether the user desires to continue playing the video poker game. If the user desires to play the video poker game again, control passes from the block 144 back to the block 130, which requests the user to make a wager. If the user does not desire to continue playing the video poker game, execution returns to the block 116 of the routine 100 of FIG. 4.

Figure 6:
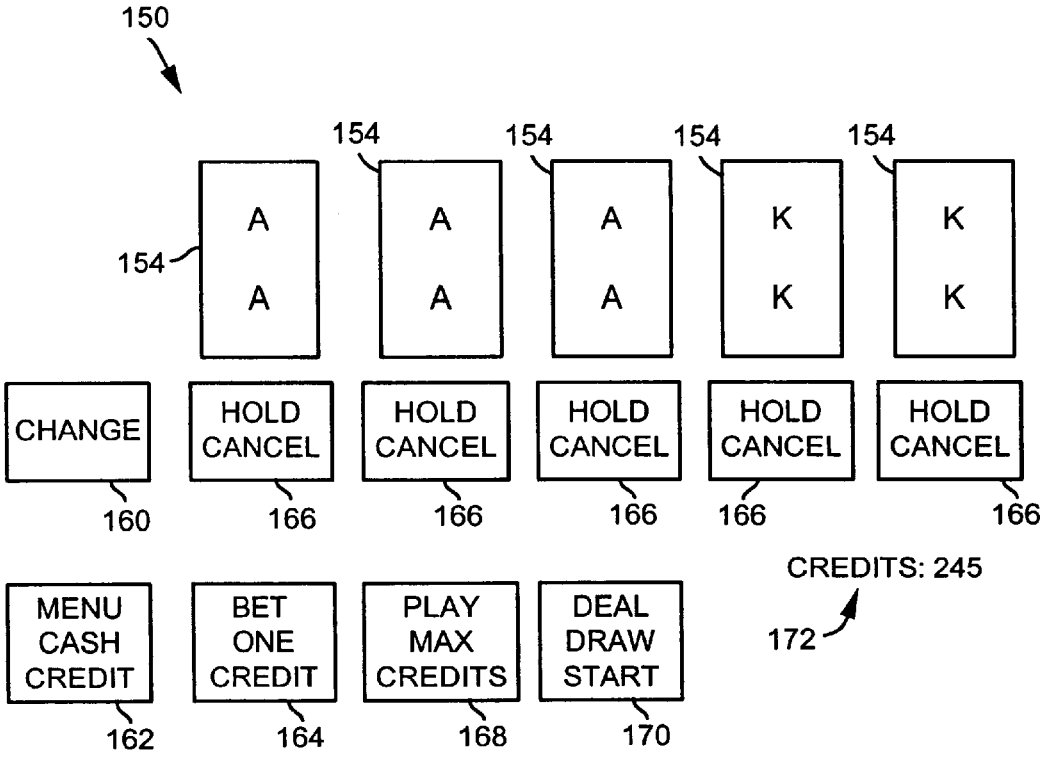
FIG. 6 is an exemplary illustration of graphics that may be displayed on the display unit when the controller of FIG. 3 executes the play video poker game routine of FIG. 5.

As shown in FIG. 6, an exemplary video display 150, which may be associated with the play video poker game routine 110, may include video images representative a plurality of cards 154 in a users hand, which may be shown face up. To allow the user to control the play of the video poker game, a plurality of button graphics may be displayed. In particular, button graphics for change 160, menu/cash/credit 162 and bet one credit 164 may be displayed. Further, button graphics for hold/cancel 166 may be displayed, each of which may pertain to a particular one of the user's cards 154. Button graphics for play max credits 168 and deal/draw/start 170 may also be displayed. As noted previously, the touch-sensitive input device may be a touch screen that may be disposed over the display unit 14. Accordingly, each of the button graphics 160–170 may be associated with a particular area of the touch-sensitive input device that is located between the display unit 14 and the user. A graphic representing the number of credits 172 may also be displayed to inform the user of the number of credits that he or she has remaining.

Figure 7:
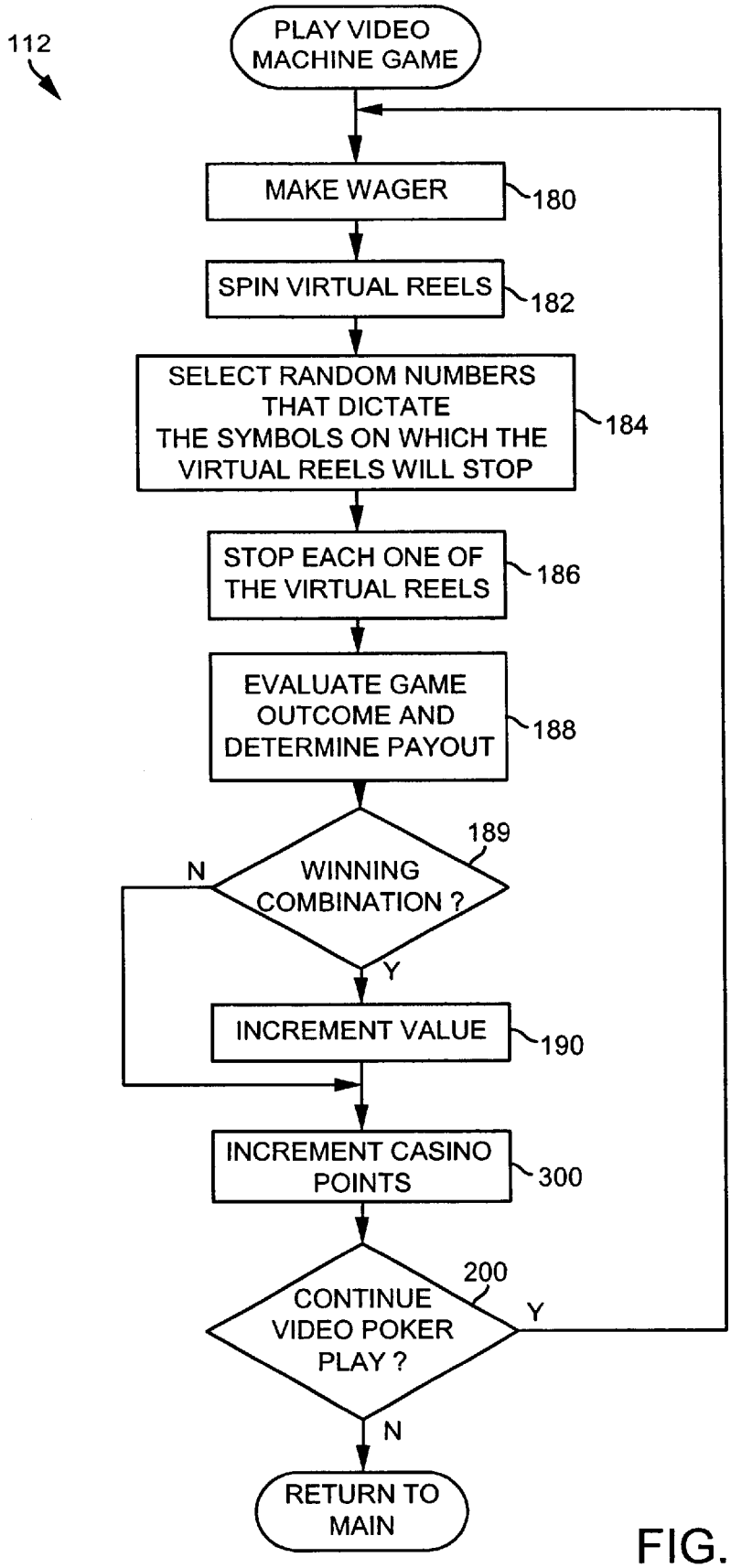
FIG. 7 is an exemplary flow diagram of a play video slot machine routine that may be implemented by the controller of FIG. 3.

When a user desires to play a video slot machine game, a play video slot machine game routine 112, as shown in FIG. 7, is executed. The routine 112 includes a number of blocks that may be embodied in software instructions stored in the memory 86 (FIG. 3). The execution of the routine 112 may begin at a block 180, at which a user may make a wager on the outcome of the video slot machine game. After the user has made an appropriate wager, control passes to a block 182. At the block 182 virtual slot machine reels, which may be embodied in video graphics, begin to spin to simulate the operation of a traditional mechanical slot machine.

While the virtual reels spin, a block 184 may select one or more random numbers that dictate the symbols on which the various virtual reels will stop when the reels cease spinning. After the block 184 completes, control passes to a block 186, which stops each one of the virtual reels from spinning according to the determined reel stop positions. The virtual reels may be stopped in a left to right manner, from the perspective of the user, or in any other suitable manner or sequence.

After the virtual reels have been stopped by the block 186, a block 188 evaluates the game outcome and determines the payout to which the user is entitled.

For example, if the virtual reels have stopped on high payout symbols, the user may receive a large payout. If, however, the virtual reels have stopped on symbols having no payout, the user loses the money that was wagered at the block 180. After the payout has been determined at the block 188, control passes to a block 189 which controls the incrementing of the users value. If the block 188 determines that the user is entitled to a payout, the block 189 passes control to a block 190 which appropriately increments the value that the user has accumulated within the electronic unit 10. If the user is not entitled to a payout, the block 189 bypasses the block 190.

After the user's value has been incremented at the block 190 or control is passed directly from block 189 after a losing spin, a block 300 increments casino points for users for which casino points are being accumulated and redeemed in a manner more fully described hereinafter. After the user's casino points have been incremented at the block 300, a block 200 determines whether the user desires to continue to playing the video slot machine game. If the user desires to play again, control passes from the block 200 back to the block 180. If, however, the user does not desire to play again, control passes to the block 116 of the main routine 100 of FIG. 4.

Figure 8:
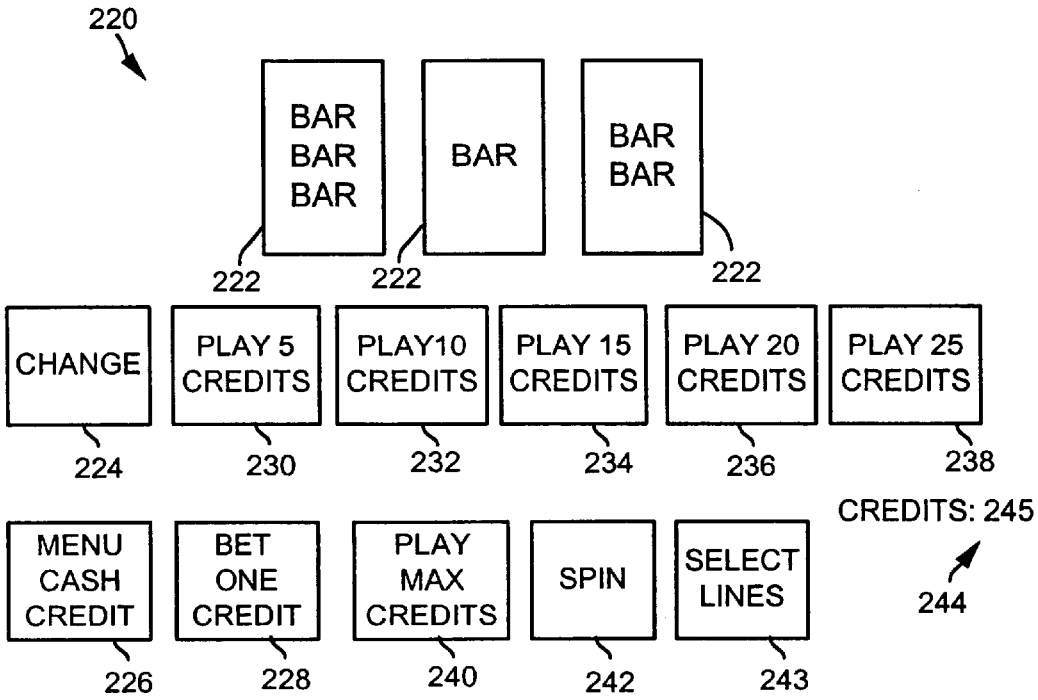
FIG. 8 is an exemplary illustration of graphics that may be displayed on the display unit when the controller of FIG. 3 executes the play video slot machine routine of FIG. 7.

As shown in FIG. 8, an exemplary video display 220, which may be associated with the play video slot machine game routine 112, may include video images that represent a plurality of virtual slot machine reels 222. While three such virtual slot machine reels 222 are shown in FIG. 8, it should be understood that any number of virtual reels could be used. To allow the user to control the play of the video slot machine, a plurality of button graphics may be displayed. In particular, button graphics for change 224, menu/cash/credit 226 and bet one credit 228 may be displayed. Further, button graphics for betting 5, 10, 15, 20 or 25 credits, shown as 230–238 in FIG. 8 may also be provided. Button graphics for play max credits 240, spin 242, and selecting particular lines on which to wager 243 may also be displayed.

As noted with respect to FIG. 6, the touch-sensitive input device may be a touch screen that may be disposed over the display unit 14. Accordingly, each of the button graphics 224–242 may be associated with a particular area of the touch-sensitive input device that is located between the display unit 14 and the user. A graphic representing the number of credits 244 may also be displayed to inform the user of the number of credits that he or she has remaining.

Figure 9:
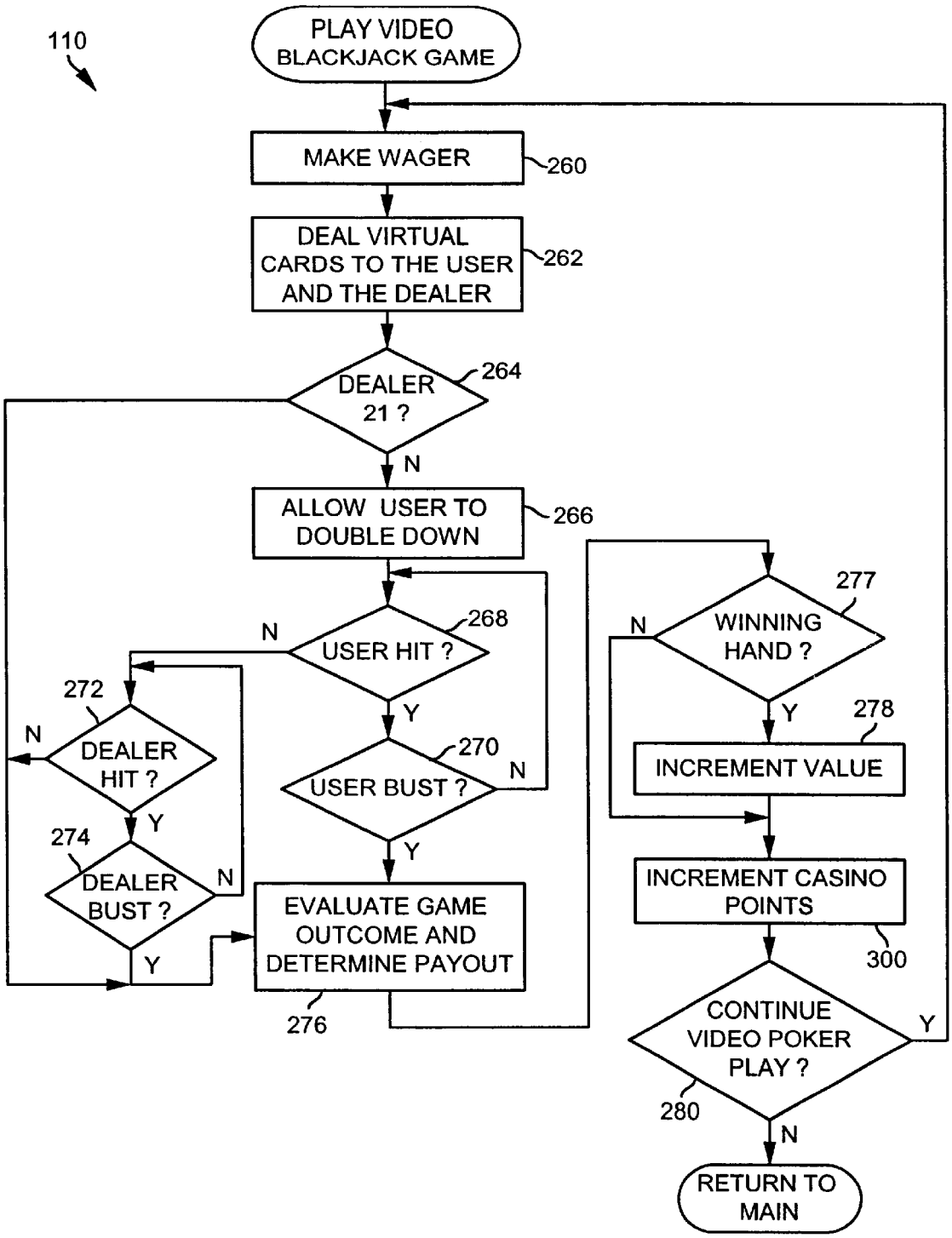
FIG. 9 is an exemplary flow diagram of a play video blackjack game routine that may be implemented by the controller of FIG. 3.

When a user desires to play a video blackjack game, a play video blackjack game routine 114, as shown in FIG. 9, is executed. The routine 114 includes a number of blocks that may be embodied in software instructions stored in the memory 86 (FIG. 3). The execution of the routine 114 may begin at a block 260 at which a user makes a wager on the outcome of the blackjack game. After the user has made a wager, a block 262 deals virtual cards to both of the user and the dealer, against which the user is playing.

After the cards are dealt, a block 264 tests whether the dealer has a hand that totals to 21. If the user does not have 21, control passes to a block 266, at which the user may double down. After the execution of the block 266, a block 268 determines whether the user wants to be "hit" (i.e., be dealt an additional card). If the user is hit, a block 270 determines if the user has "bust" (i.e., has exceeded 21). If the user has not bust, control passes back to the block 268, which allows the user to hit again.

If the user decides not to hit, control passes from the block 268 to a block 272, which determines if the dealer wants to hit. If the dealer hits, control passes to a block 274, which determines if the dealer has bust. If the dealer has not bust, control passes from the block 274 back to the block 272 to provide the dealer another opportunity to hit. If the dealer decides not to hit, control passes to a block 276, which determines the outcome of the blackjack game. For example, the block 276 may determine which of the user or the dealer has the higher hand that does not exceed 21. Additionally, if the user busts at the block 270 or the dealer busts at the block 274 or if the block 264 determines that the dealer has 21, control passes to the block 276. In sum, the block 276 performs the function of evaluating the traditional rules of blackjack and determining the magnitude of the payout that should be paid to the user.

After the payout has been determined at the block 276, control passes to a block 277 which controls the incrementing of the users value. If the block 276 determines that the user is entitled to a payout, the block 277 passes control to a block 278 which appropriately increments the value that the user has accumulated within the electronic unit 10. If the user is not entitled to a payout, the block 277 bypasses the block 278. After the user's value has been incremented at the block 278 or control is passed directly from block 277 after a losing hand, a block 300 increments casino points for users for which casino points are being accumulated and redeemed in a manner more fully described hereinafter. After the user's casino points have been incremented at the block 300, a block 280 determines whether the user desires to play another game of blackjack. If the user desires to play blackjack again, control passes to the block 260. Alternatively, if the user does not desire to play blackjack again, control passes to the block 116 of the main routine 100 of FIG. 4.

Figure 10:
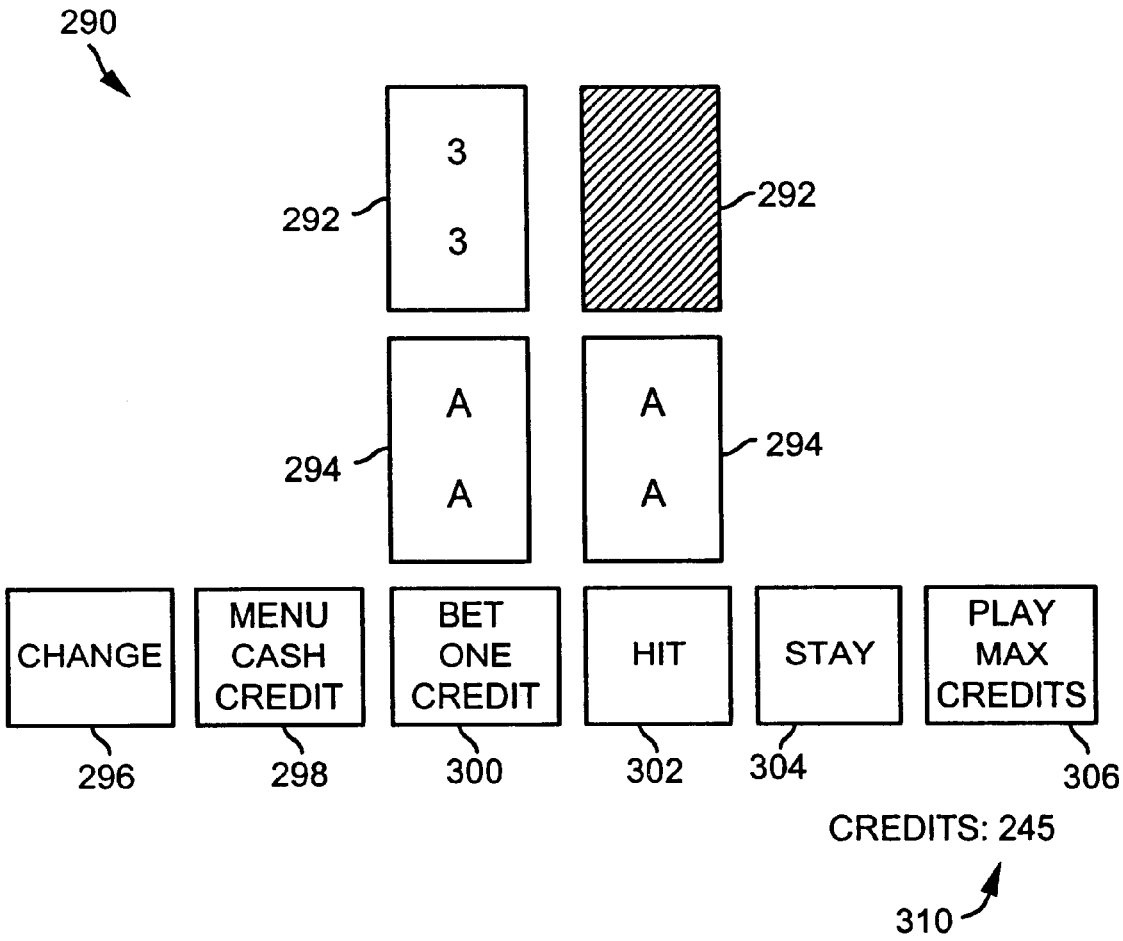
FIG. 10 is an exemplary illustration of graphics that may be displayed on the display unit when the controller of FIG. 3 executes the play video blackjack game routine of FIG. 9.

As shown in FIG. 10, an exemplary video display 290, which may be associated with the play video blackjack game routine 114, may include video images that represent a plurality of cards 292 that form a dealer's hand of cards and a plurality of cards 294 that form the user's hand of cards. To allow the user to control the play of the video blackjack game, a plurality of button graphics may be displayed. In particular, button graphics for change 296, menu/cash/credit 298 and bet one credit 300 may be displayed. Further, button graphics for hit 302, stay 304 and play max credits 306, as shown in FIG. 10 may also be provided. As noted with respect to FIGS. 6 and 8, the touch-sensitive input device may be a touch screen that may be disposed over the display unit 14. Accordingly, each of the button graphics 296–306 may be associated with a particular area of the touch-sensitive input device that is located between the display unit 14 and the user. A graphic representing the number of credits 310 may also be displayed to inform the user of the number of credits that he or she has remaining.

Figure 11:
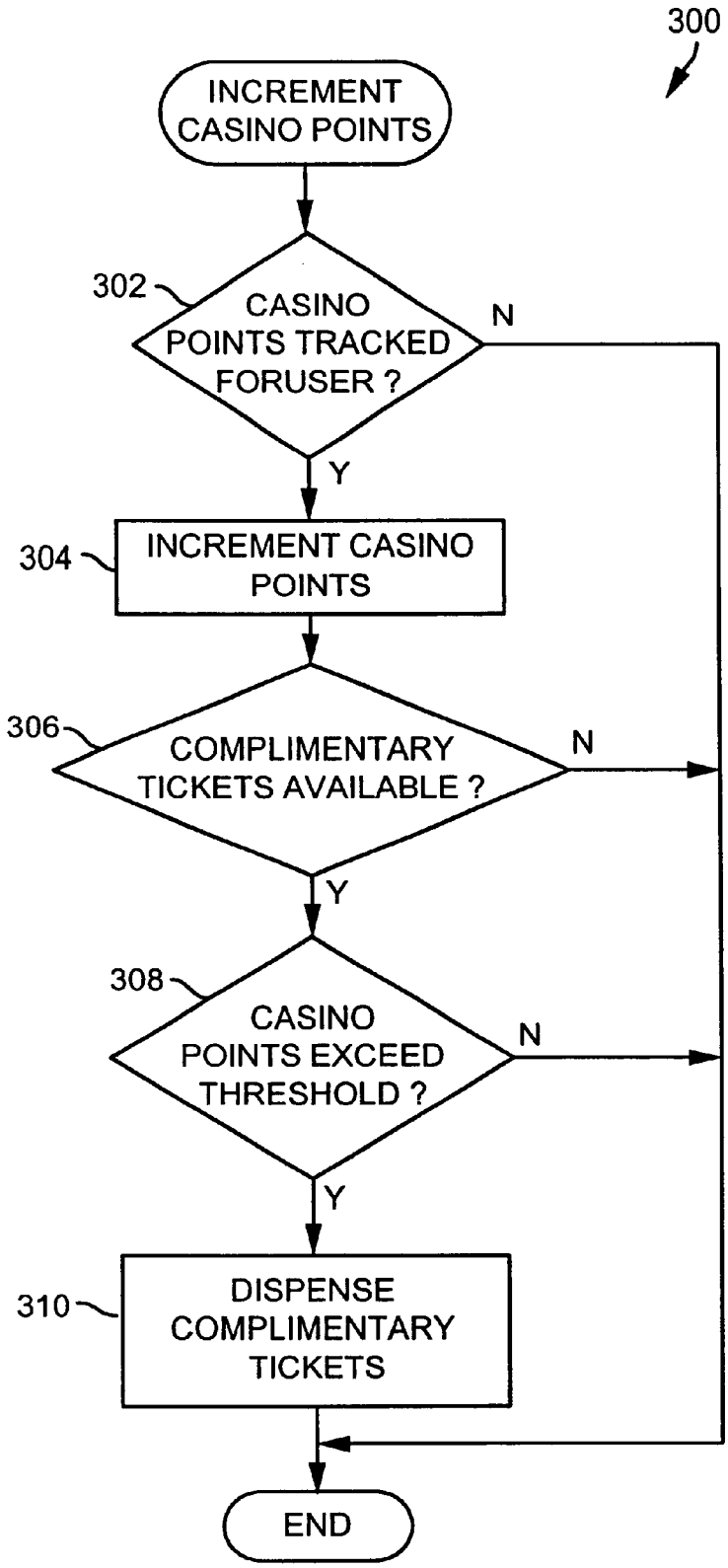
FIG. 11 is an exemplary flow diagram of an increment casino points routine that may be implemented by the controller of FIG. 3.

As previously discussed, at the end of each game subroutine 110–114, the user's casino points are incremented at the block 300, which is illustrated in detail in FIG. 11. The routine 300 includes a number of blocks that may be embodied in software instructions stored in memory 86 (FIG. 3). The execution of the routine 300 may begin at a block 302 at which the controller 80 determines whether casino points are tracked for the user. Users depositing coins in slot 34 or paper currency in bill acceptor 36 may not have casino points accumulated, while a user inserting a smart card or player tracking card in the card reader 38 may accumulate casino points on the smart card or in the player tracking system. Additionally, the gambling unit 10 could accumulate casino points for the former users until they quit playing at block 116 (FIG. 4). If the controller 80 determines that casino points are being tracked, control passes to a block 304 at which the controller 80 increments the user's casino points to reflect the previously completed game and save the updated casino point total in the appropriate location, such as the memory 88, the user's smart card, or the user information stored at the player tracking system. If the controller 80 determines that casino points are not being tracked, control passes back to the appropriate subroutine 110–114.

After the casino points are incremented at the block 304, control passes to a block 306 where the controller 80 determines whether complementary tickets are available to be dispensed from the gambling unit 10. If the gambling unit 10 dispenses only a single type of value, or dispenses multiple types of value, none of which are complementary tickets, then control is returned to the appropriate subroutine 110–114. If multiple types of value are available from a dispenser such as the multi-compartment dispenser 46, one of which being complementary tickets, control passes to block 308 at which the controller 80 determines whether the user's accumulated casino points exceed a predetermined threshold for awarding complementary tickets to the user. Such threshold may be stored in the gambling unit 10 in memories 86 or 88, on the user's smart card, or in the player tracking system. If the user is entitled to receive a complementary ticket, control passes to a block 310 at which the controller 80 causes the dispenser 46 to dispense the complementary ticket or tickets to the user. After dispensing the complementary ticket, or if no ticket is to be dispensed, control returns to the appropriate subroutine 110–114.

Figure 12:
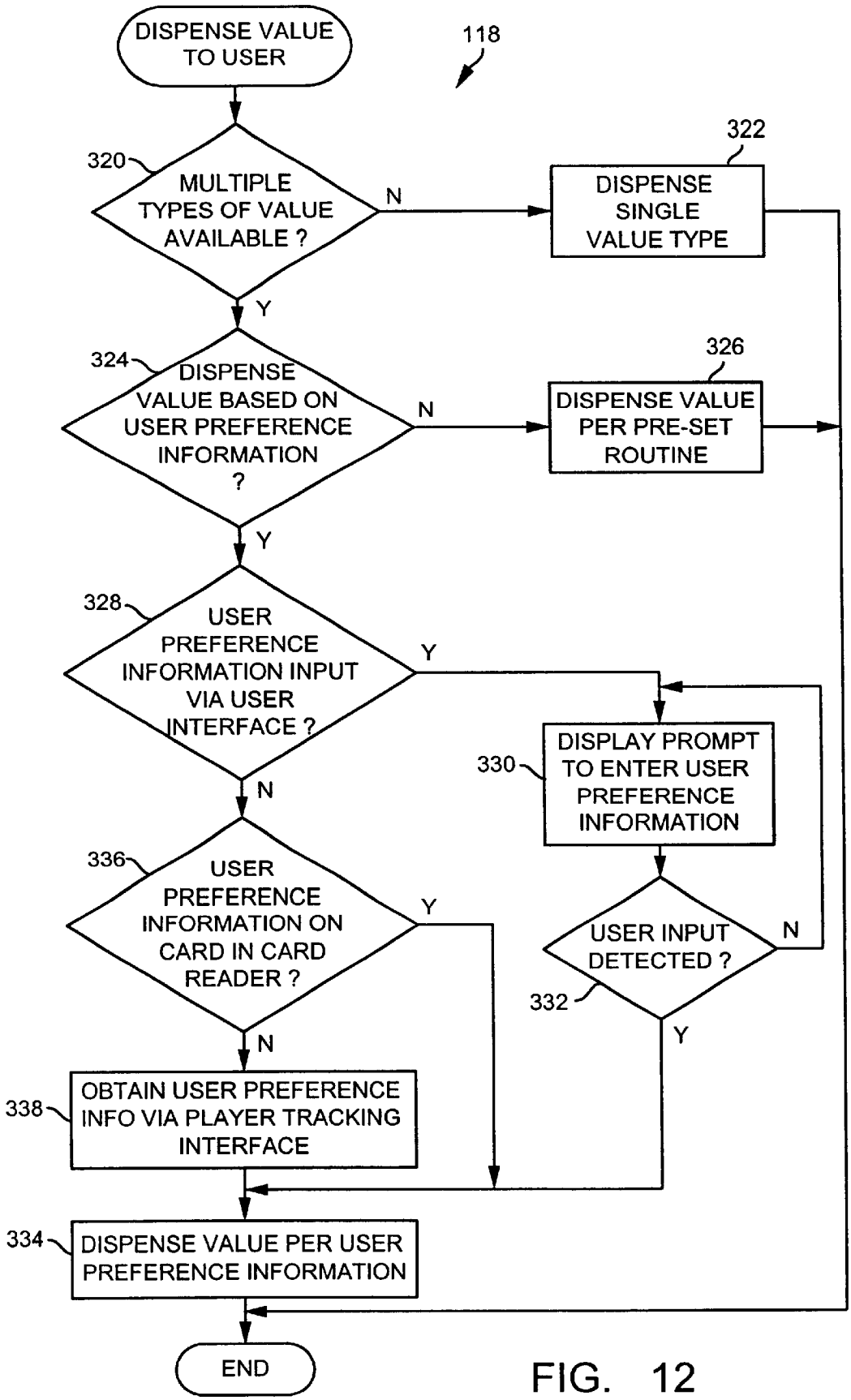
FIG. 12 is an exemplary flow diagram of a dispense value to user routine that may be implemented by the controller of FIG. 3.

When the block 116 determines that the user desires to quit the game, control passes to the subroutine 118, which is illustrated in detail in FIG. 12. The routine 118 includes a number of blocks that may be embodied in software instructions stored in memory 86 (FIG. 3). The execution of the routine 118 may begin at a block 320 at which the controller 80 determines whether multiple types of value are available for dispensing to the user. If only a single type of value is available, such as a single denomination of coins, game tokens, award tickets, etc., control passes to block 322 to dispense the single type of value in an amount equal to the credits accumulated by the user during game play.

If multiple types of value are available for dispensing from the gambling unit 10, control passes to block 324 at which the controller 80 determines whether the gambling unit 10 dispenses the available types of value based on user preference information. If the types of value are not dispensed based on user preference information, control passes to block 326 at which the controller 80 dispenses one or more of the available types of value based on a preset routine stored in the memory 86. For example, the gambling unit 10 may include a multicompartment dispenser 46 having the first compartment 50 contain $10 award tickets and the second compartment 54 containing $1 award tickets, with the memory 86 having a routine that dispenses a combination of the $10 and $1 award tickets totaling the credit accumulated by the user. If the user accumulates $55 in credit, the controller 80 executes the dispensing routine in the memory 86 and dispenses, for example, five $10 award tickets from the first compartment 50 and five $1 award tickets from the second compartment 52.

If the types of value are dispensed based on user preference information, the information may be obtained from a user interface, such as the buttons 22–28 and 32, the display unit 14 having a touch-sensitive video display screen, or the card reader 38, and control passes to block 328 to determine the source of the user preference information. At block 328, the controller 80 determines whether the user preference information will be obtained via a manual user input device such as the buttons 22–28 and 32, or the display unit 14 having a touch-sensitive video display screen described herein. If the controller 80 determines that the user preference information will be obtained via a user input device, control passes to block 330 at which graphics may be displayed on the display unit 14 prompting the user to input user preference information via the user input device. Prompting graphics may include a list of the types of value that may be dispensed by the gambling unit 10 and the associated user input devices for selecting the types of value. While graphics are being displayed, a block 332 intermittently checks to see if user input is detected. Such a function may be carried out by, for example, polling the buttons 22–28 and 32 or the touch-sensitive video display screen. Alternatively, the buttons 22–28 and 32, and touch-sensitive video display screen may be configured to notify the controller 80 when a user selection is detected. As long as no user input is detected, control passes from the block 332 back to the block 330. If, however, the block 332 determines that a user has made a selection, control passes to a block 334 wherein the controller 80 causes the gambling unit 10 to dispense one or more of the available types of value according to the user preference information.

As an example, the first compartment 50 may contain token bills of a certain denomination, such as $1 token bills, and the second compartment 52 may contain coupons having a monetary value and being redeemable for one or more of free game, tokens, gifts, meals, rides, shows, money, or other goods or services offered by the casino. Alternatively, the first compartment 50 may contain coupons redeemable for one of the aforementioned types of goods or services, and the second compartment 52 may contain coupons redeemable for a different one of the aforementioned types of goods or services. Depending on the awards available to be dispensed from compartments 50, 52, the video display 14 may prompt the user via a value selection graphic to make specified selections on the touch-sensitive input device to pay out the accumulated credits in the form of the awards available in the first compartment 50, the awards available in the second compartment 52, the coins or tokens available at the payout tray 40, or a combination of the available types of awards. The users input their selections at the touch-sensitive input device, and the gambling unit 10 dispenses one or more of the available types of value based on the selections made by the users.

If the controller 80 determines that the user preference information is not obtained via a user input device, control passes to block 336 at which the controller 80 determines whether the player tracking card or smart card inserted into the card reader 38 stores user preference information or user identification information that may be used to obtain user preference information from the player tracking system. If the block 336 determines that the user preference information is stored on the card in the card reader 38, control passes directly to the block 334 wherein the controller 80 causes the gambling unit 10 to dispense one or more of the available types of value according to the user preference information stored on the card. If, however, the block 336 determines that the card stores user identification information, control passes to block 338 at which the controller 80 uses the player identification information store on the card to obtain user preference information from the player tracking system via the player tracking interface 94. Once the user preference information is obtained, control passes to the block 334 to dispense one or more of the available types of value according to the user preference information from the player tracking system. After the block 334 has completed execution by dispensing value, execution returns to the block 102 of the routine 100 of FIG. 4 for display of the user attraction graphics.

As a further example of subroutine 118, user preference information may be obtained from a player tracking system using identification information stored on a card in the card reader 38. The first compartment 50 may contain coupons redeemable for goods or gifts in the shops of the casino, and the second compartment 52 may contain complementary coupons for meals at restaurants in the casino. When the user desires to redeem the accumulated credits, the processor 80, using the player identification information stored on a smart card or player tracking card inserted in the card reader 38, obtains user preference information stored in the player tracking system via the player tracking interface 94. The processor 80 then determines the type of coupon(s) to be dispensed based on the user preference information and causes the dispenser 46 to dispense the appropriate coupon (s) from the proper compartment 50 or 52.

Other combinations of types of awards and inputting user preference information are contemplated by the inventor as having use with the present invention. Moreover, although the dispenser 46 is described herein as having two compartments 50, 52, it is contemplated that the method and apparatus may be implemented in electronic gambling units 10 with dispensers 46 having more than two compartments or areas within the dispenser 46 for coupons, token bills, paper currency and the like, with each containing a different type of award.

Numerous modifications and alternative embodiments of the invention will be apparent to those skilled in the art in view of the foregoing description. Accordingly, this description is to be construed as illustrative only and not as limiting to the scope of the invention. The details of the structure may be varied substantially without departing from the spirit of the invention, and the exclusive use of all modifications, which are within the scope of the appended claims, is reserved.

What is claimed is:

1. An electronic gambling unit for allowing a user to play a video gambling game selected from the group of video gambling games consisting of video poker, video slots and video black jack, and for dispensing at least one of a plurality of types of value to the user at the conclusion of the video gambling game, the electronic gambling unit comprising:

a display unit capable of generating color images;

an input device that allows the user to input information;

a value-accepting mechanism that is capable of allowing the user to deposit a medium of currency;

a value-dispensing mechanism having a first area containing a first item representing a first type of value and a second area containing a second item representing a second type of value, the value-dispensing mechanism being capable of dispensing the first and the second items to the user; and a controller operatively coupled to the display unit, the input device, the value-accepting mechanism, and the value-dispensing mechanism, the controller comprising a processor and a memory operatively coupled to the processor, the controller being programmed to allow the user to make a wager, the controller being programmed to cause a video image to be generated on the display unit after the user makes a wager, the video image representing a video gambling game selected from the group of video gambling games consisting of video poker, video slots and video blackjack, the controller being programmed to determine, after the video image has been displayed, an outcome of the video gambling game represented by the video image and to determine a payout associated with the outcome of the video gambling game, and the controller being programmed to cause the value-dispensing mechanism to dispense at least one of the first and the second items to the user after the payout has been determined, wherein the at least one item dispensed is determined based on user preference information corresponding to the information input by the user at the input device.

2. The electronic gambling unit of claim 1, wherein the input device comprises a plurality of buttons, and the controller is programmed to cause the display unit to generate a value selection graphic instructing the user to select at least one of the first and the second types of value after the payout has been determined, to allow the user to select at least one of the first and the second types of value via the plurality of buttons, and to cause the value-dispensing mechanism to dispense at least one of the first and the second items based on the selection made by the user via the plurality of buttons.

3. The electronic gambling unit of claim 1, wherein the display unit comprises a touch-sensitive video display screen and wherein the input device comprises part of the touch-sensitive video display screen, and the controller is programmed to cause the touch-sensitive video display screen to generate a value selection graphic instructing the user to select at least one of the first and the second types of value after the payout has been determined, to allow the user to select at least one of the first and the second types of value via the part of the touch-sensitive video display screen, and to cause the value-dispensing mechanism to dispense at least one of the first and the second items based on the selection made by the user via the part of the touch-sensitive video display screen.

4. The electronic gambling unit of claim 1, wherein the input device comprises an electronic reader that is capable of reading an object having user preference stored thereon, and the controller is programmed to cause the electronic reader to transmit user preference stored on the object to the controller, and to cause the value-dispensing mechanism to dispense at least one of the first and the second items based on the user preference.

5. The electronic gambling unit of claim 1, wherein the input device comprises an electronic reader that is capable of reading an object having user identification stored thereon, the electronic gambling unit further comprising a player tracking interface connecting the electronic gambling unit to a player tracking system, and wherein the controller is programmed to transmit user identification stored on the object to the player tracking system via the player tracking interface, to receive user preference related to the user identification from the player tracking system via the player tracking interface, and to cause the value-dispensing mechanism to dispense at least one of the first and the second items based on the user preference.

6. The electronic gambling unit of claim 1, wherein the controller is programmed to increment user information indicative of the volume and frequency with which the user plays the electronic gambling unit, determines after incrementing the user information whether the user information exceeds a threshold value, and causes the value-dispensing mechanism to dispense one of the first and the second items to the user if the user information exceeds the threshold value.

7. An electronic gambling unit for allowing a user to play a video gambling game selected from the group of video gambling games consisting of video poker, video slots and video black jack, and for dispensing at least one of a plurality of types of value to the user at the conclusion of the video gambling game, the electronic gambling unit comprising:

a display unit capable of generating color images;

an input device that allows the user to make a plurality of input selections;

an electronic reader capable of reading an object having data stored thereon;

a value-dispensing mechanism having a first item representing a first type of value and a second item representing a second type of value, the value-dispensing mechanism being capable of dispensing the first and the second items to the user; and a controller operatively coupled to the display unit, the input device, the electronic reader, and the value-dispensing mechanism, the controller comprising a processor and a memory operatively coupled to the processor, the controller being programmed to allow the user to make a wager, the controller being programmed to cause a video image to be generated on the display unit after the user makes a wager, the video image representing a video gambling game selected from the group of video gambling games consisting of video poker, video slots and video blackjack, the controller being programmed to determine, after the video image has been displayed, an outcome of the video gambling game represented by the video image and to determine a payout associated with the outcome of the video gambling game, and the controller being programmed to cause the value-dispensing mechanism to dispense at least one of the first and the second items to the user after the payout has been determined, wherein the at least one item dispensed is determined based on the data stored on the object.

8. The electronic gambling unit of claim 7, wherein the data stored on the object is user preference data, and the controller is programmed to cause the electronic reader to transmit the user preference data stored on the object to the controller, and to cause the value-dispensing mechanism to dispense at least one of the first and the second items based on the user preference data.

9. The electronic gambling unit of claim 7, wherein the data stored on the object is user identification data, the electronic gambling unit further comprising a player tracking interface connecting the electronic gambling unit to a player tracking system, and wherein the controller is programmed to transmit the user identification data stored on the object to the player tracking system via the player tracking interface, to receive user preference data related to the user identification data from the player tracking system via the player tracking interface, and to cause the value-dispensing mechanism to dispense at least one of the first and the second items based on the user preference data.

10. The electronic gambling unit of claim 7, wherein the controller is programmed to increment user information indicative of the volume and frequency with which the user plays the electronic gambling unit, determines after incrementing the user information whether the user information exceeds a threshold value, and causes the value-dispensing mechanism to dispense one of the first and the second items to the user if the user information exceeds the threshold value.

11. An electronic gambling unit for allowing a user to play a video gambling game, and for dispensing at least one of a plurality of types of value to the user at the conclusion of the video gambling game, the electronic gambling unit comprising:

a display unit capable of generating color images;

an input device that allows the user to input information;

a value-accepting mechanism that is capable of allowing the user to deposit a medium of currency;

a value-dispensing mechanism having a first area containing a first item representing a first type of value and a second area containing a second item representing a second type of value, the value-dispensing mechanism being capable of dispensing the first and the second items to the user; and a controller operatively coupled to the display unit, the input device, the value-accepting mechanism, and the value-dispensing mechanism, the controller comprising a processor and a memory operatively coupled to the processor, the controller being programmed to allow the user to make a wager, the controller being programmed to cause a video image representing the video gambling game to be generated on the display unit after the user makes a wager, the controller being programmed to determine, after the video image has been displayed, an outcome of the video gambling game represented by the video image and to determine a payout associated with the outcome of the video gambling game, and the controller being programmed to cause the value-dispensing mechanism to dispense at least one of the first and the second items to the user after the payout has been determined, wherein the at least one item dispensed is determined based on user preference information corresponding to the information input by the user at the input device.

12. The electronic gambling unit of claim 11, wherein the input device comprises a plurality of buttons, and the controller is programmed to cause the display unit to generate a value selection graphic instructing the user to select at least one of the first and the second type of value after the payout has been determined, to allow the user to select at least one of the first and the second type of value via the plurality of buttons, and to cause the value-dispensing mechanism to dispense at least one of the first and the second items based on the selection made by the user via the plurality of buttons.

13. The electronic gambling unit of claim 11, wherein the display unit comprises a touch-sensitive video display screen and wherein the input device comprises part of the touch-sensitive video display screen, and the controller is programmed to cause the touch-sensitive video display screen to generate a value selection graphic instructing the user to select at least one of the first and the second type of value after the payout has been determined, to allow the user to select at least one of the first and the second type of value via the part of the touch-sensitive video display screen, and to cause the value-dispensing mechanism to dispense at least one of the first and the second items based on the selection made by the user via the part of the touch-sensitive video display screen.

14. The electronic gambling unit of claim 11, wherein the input device comprises an electronic reader that is capable of reading an object having user preference data stored thereon, and the controller is programmed to cause the electronic reader to transmit user preference data stored on the object to the controller, and to cause the value-dispensing mechanism to dispense at least one of the first and the second items based on the user preference data.

15. The electronic gambling unit of claim 11, wherein the input device comprises an electronic reader that is capable of reading an object having user identification data stored thereon, the electronic gambling unit further comprising a player tracking interface connecting the electronic gambling unit to a player tracking system, and wherein the controller is programmed to transmit user identification data stored on the object to the player tracking system via the player tracking interface, to receive user preference data related to the user identification data from the player tracking system via the player tracking interface, and to cause the value-dispensing mechanism to dispense at least one of the first and the second items based on the user preference data.

16. The electronic gambling unit of claim 11, wherein the controller is programmed to increment user information indicative of the volume and frequency with which the user plays the electronic gambling unit, determines after incrementing the user information whether the user information exceeds a threshold value, and causes the value-dispensing mechanism to dispense one of the first and the second items to the user if the user information exceeds the threshold value.

17. An electronic gambling unit for allowing a user to play a video gambling game, and for dispensing at least one of a plurality of types of value to the user at the conclusion of the video gambling game, the electronic gambling unit comprising:

a display unit capable of generating color images;

an input device that allows the user to make a plurality of input selections;

an electronic reader capable of reading an object having data stored thereon;

a value-dispensing mechanism having a first item representing a first type of value and a second item representing a second type of value, the value-dispensing mechanism being capable of dispensing the first and the second items to the user; and a controller operatively coupled to the display unit, the input device, the electronic reader, and the value-dispensing mechanism, the controller comprising a processor and a memory operatively coupled to the processor, the controller being programmed to allow the user to make a wager, the controller being programmed to cause a video image representing the video gambling game to be generated on the display unit after the user makes a wager, the controller being programmed to determine, after the video image has been displayed, an outcome of the video gambling game represented by the video image and to determine a payout associated with the outcome of the video gambling game, and the controller being programmed to cause the value-dispensing mechanism to dispense at least one of the first and the second items to the user after the payout has been determined, wherein the at least one item dispensed is determined based on data stored on the object.

18. The electronic gambling unit of claim 17, wherein the data stored on the object is user preference data, and the controller is programmed to cause the electronic reader to transmit the user preference data stored on the object to the controller, and to cause the value-dispensing mechanism to dispense at least one of the first and the second items based on the user preference data.

19. The electronic gambling unit of claim 17, wherein the data stored on the object is user identification data, the electronic gambling unit further comprising a player tracking interface connecting the electronic gambling unit to a player tracking system, and wherein the controller is programmed to transmit the user identification data stored on the object to the player tracking system via the player tracking interface, to receive user preference data related to the user identification data from the player tracking system via the player tracking interface, and to cause the value-dispensing mechanism to dispense at least one of the first and the second items based on the user preference data.

20. The electronic gambling unit of claim 17, wherein the controller is programmed to increment user information indicative of the volume and frequency with which the user plays the electronic gambling unit, determines after incrementing the user information whether the user information exceeds a threshold value, and causes the value-dispensing mechanism to dispense one of the first and the second items to the user if the user information exceeds the threshold value.

21. A method of dispensing at least one of a plurality of items each representing a type of value to a user at the conclusion of a video gambling game of an electronic gambling unit having a display unit capable of generating color images, an input device that allows the user to input information, a value-accepting mechanism that is capable of allowing the user to deposit a medium of currency, and a value-dispensing mechanism containing a first item representing a first type of value and a second item representing a second type of value and being capable of dispensing the first and the second items to the user, the method comprising:

allowing the user make a wager;

generating a video image representing the video gambling game on the display unit of the video gambling unit after the user makes a wager;

determining, after the video image has been generated, an outcome of the video gambling game represented by the video image;

determining a payout associated with the outcome of the video gambling game; and dispensing at least one of the first and the second items to the user after determining the payout via the value-dispensing mechanism and based on information input by the user at the input device.

22. The method of claim 21, wherein the input device comprises a plurality of buttons, the method comprising:

generating at the display unit of the video gambling game a value selection graphic instructing the user to select at least one of the first and the second types of value;

allowing the user to select at least one of the first and the second types of value via the plurality of buttons; and causing the value-dispensing mechanism to dispense at least one of the first and the second items based on the selection made by the user via the plurality of buttons.

23. The method of claim 21, wherein the electronic gambling game comprises a touch-sensitive video display screen and the input device comprises part of the touch-sensitive video display screen, the method comprising:

generating at the touch-sensitive video display screen a value selection graphic instructing the user to select at least one of the first and the second types of value;

allowing the user to select at least one of the first and the second types of value via the part of the touch-sensitive video display screen; and causing the value-dispensing mechanism to dispense at least one of the first and the second items based on the selection made by the user via the part of the touch-sensitive video display screen.

24. The method of claim 21, wherein the input device comprises an electronic reader that is capable of reading an object having user preference data stored thereon, the method comprising causing the value-dispensing mechanism to dispense at least one of the first and the second items based on the user preference data stored on the item.

25. The method of claim 21, wherein the electronic gambling unit comprises a player tracking interface connecting the electronic gambling unit to a player tracking system and the input device comprises an electronic reader that is capable of reading an object having user identification data stored thereon, the method comprising:

transferring user identification data stored on the item to the player tracking system via the player tracking interface;

receiving user preference data related to the user identification data from the player tracking system via the player tracking interface; and causing the value-dispensing mechanism to dispense at least one of the first and the second items based on the user preference data.

26. The method of claim 21, comprising:

incrementing user information indicative of the volume and frequency with which the user plays the electronic gambling unit;

determining after incrementing the user information whether the user information exceeds a threshold value; and causing the value-dispensing mechanism to dispense one of the first and the second items to the user if the user information exceeds the threshold value.

27. A programmed memory that is capable of being used in connection with an electronic gambling unit that allows a user to play a video gambling game, that dispenses at least one of a plurality of items, each item representing a type of value, to the user at the conclusion of the video gambling game, and that comprises a processor, an input device, a value-accepting mechanism, and a value-dispensing mechanism, the programmed memory comprising:

a first memory portion physically configured in accordance with computer program instructions that would cause the electronic gambling unit to execute the video gambling game if the programmed memory were incorporated into the electronic gambling unit;

a second memory portion physically configured in accordance with computer program instructions that would cause said electronic gambling unit to determine an outcome of the video gambling game if the programmed memory were incorporated into the electronic gambling unit;

a third memory portion physically configured in accordance with computer program instructions that would cause said electronic gambling unit to determine a payout associated with the outcome of the video gambling game if the programmed memory were incorporated into the electronic gambling unit;

a fourth memory portion physically configured in accordance with computer program instructions that would cause said electronic gambling unit to allow the user to input user information via the input device if the programmed memory were incorporated into the electronic gambling unit; and a fifth memory portion physically configured in accordance with computer program instructions that would cause said electronic gambling unit to cause the value-dispensing mechanism to dispense at least one of the plurality of items to the user after the payout has been determined, the at least one item dispensed being determined based on the user information input via the input device, if the programmed memory were incorporated into the electronic gambling unit.

28. The programmed memory of claim 27, wherein the programmed memory is capable of being used in connection with an electronic gambling unit having a display unit and an input device comprising a plurality of buttons, the programmed memory further comprising:

a sixth memory portion physically configured in accordance with computer program instructions that would cause the electronic gambling unit to generate at the display unit a value selection graphic instructing the user to select at least one of the first and the second types of value if the programmed memory were incorporated into the electronic gambling unit;

a seventh memory portion physically configured in accordance with computer program instructions that would cause the electronic gambling unit to allow the user to select at least one of the first and the second types of value via the plurality of buttons if the programmed memory were incorporated into the electronic gambling unit; and an eighth memory portion physically configured in accordance with computer program instructions that would cause the electronic gambling unit to dispense from the value-dispensing mechanism at least one of the first and the second items based on the selection made by the user via the plurality of buttons if the programmed memory were incorporated into the electronic gambling unit.

29. The programmed memory of claim 27, wherein the programmed memory is capable of being used in connection with an electronic gambling unit having a touch-sensitive video display screen and a user interface comprising part of the touch-sensitive video display screen, the programmed memory further comprising:

a sixth memory portion physically configured in accordance with computer program instructions that would cause the electronic gambling unit to generate at the touch-sensitive video display screen a value selection graphic instructing the user to select at least one of the first and the second types of value if the programmed memory were incorporated into the electronic gambling unit;

a seventh memory portion physically configured in accordance with computer program instructions that would cause the electronic gambling unit to allow the user to select at least one of the first and the second types of value via the part of the touch-sensitive video display screen if the programmed memory were incorporated into the electronic gambling unit; and an eighth memory portion physically configured in accordance with computer program instructions that would cause the electronic gambling unit to dispense from the value-dispensing mechanism at least one of the first and the second items based on the selection made by the user via the part of the touch-sensitive video display screen if the programmed memory were incorporated into the electronic gambling unit.

30. The programmed memory of claim 27, wherein the programmed memory is capable of being used in connection with an electronic gambling unit having a user interface comprising an electronic reader that is capable of reading an object having user preference data stored thereon, the programmed memory further comprising:

a sixth memory portion physically configured in accordance with computer program instructions that would cause the electronic gambling unit to transmit user preference data stored on the object from the electronic reader to the controller if the programmed memory were incorporated into the electronic gambling unit; and a seventh memory portion physically configured in accordance with computer program instructions that would cause the electronic gambling unit to cause the value-dispensing mechanism to dispense at least one of the first and the second items based on the user preference data if the programmed memory were incorporated into the electronic gambling unit.

31. The programmed memory of claim 27, wherein the programmed memory is capable of being used in connection with an electronic gambling unit having a user interface comprising an electronic reader that is capable of reading an object having user identification data stored thereon, and the electronic gambling unit further comprising a player tracking interface connecting the electronic gambling unit to a player tracking system, the programmed memory further comprising:

a sixth memory portion physically configured in accordance with computer program instructions that would cause the electronic gambling unit to transmit user identification data stored on the object to the player tracking system via the player tracking interface if the programmed memory were incorporated into the electronic gambling unit;

a seventh memory portion physically configured in accordance with computer program instructions that would cause the electronic gambling unit to receive user preference data related to the user identification data from the player tracking system via the player tracking interface if the programmed memory were incorporated into the electronic gambling unit; and an eighth memory portion physically configured in accordance with computer program instructions that would cause the electronic gambling unit to cause the value-dispensing mechanism to dispense at least one of the first and the second items based on the user preference data if the programmed memory were incorporated into the electronic gambling unit.

32. The programmed memory of claim 27, further comprising:

a sixth memory portion physically configured in accordance with computer program instructions that would cause the electronic gambling unit to increment user information indicative of the volume and frequency with which the user plays the electronic gambling unit if the programmed memory were incorporated into the electronic gambling unit;

a seventh memory portion physically configured in accordance with computer program instructions that would cause the electronic gambling unit to determine after incrementing the user information whether the user information exceeds a threshold value if the programmed memory were incorporated into the electronic gambling unit; and an eighth memory portion physically configured in accordance with computer program instructions that would cause the electronic gambling unit to cause the value-dispensing mechanism to dispense one of the first and the second items to the user if the user information exceeds the threshold value cause if the programmed memory were incorporated into the electronic gambling unit.

33. The programmed memory of claim 27, wherein the programmed memory comprises a semi-conductor memory.

34. The programmed memory of claim 27, wherein the programmed memory comprises an optically-readable memory.

35. The programmed memory of claim 22, wherein the programmed memory comprised a magnetic memory.

* * * * *